US009885142B2

(12) United States Patent
Stegerwald

(10) Patent No.: US 9,885,142 B2
(45) Date of Patent: Feb. 6, 2018

(54) TUMBLE DRYER WITH AUTOMATIC FIRE EXTINGUISHING SYSTEM

(71) Applicant: BSH Hausgeräte GmbH, Munich (DE)

(72) Inventor: Gerhard Stegerwald, Virginia Beach, VA (US)

(73) Assignee: BSH HAUSGERÄTE GmbH, Munich (DE)

( * ) Notice: Subject to any disclaimer, the term of this patent is extended or adjusted under 35 U.S.C. 154(b) by 700 days.

(21) Appl. No.: 13/721,097

(22) Filed: Dec. 20, 2012

(65) Prior Publication Data

US 2013/0167400 A1 Jul. 4, 2013

(30) Foreign Application Priority Data

Jan. 4, 2012 (DE) ..... 10 2012 200 075

(51) Int. Cl.

| | |
|---|---|
| ***D06F 58/04*** | (2006.01) |
| ***D06F 58/28*** | (2006.01) |
| ***A62C 35/10*** | (2006.01) |
| ***A62C 3/00*** | (2006.01) |
| ***A62C 3/16*** | (2006.01) |
| *F26B 25/00* | (2006.01) |

(52) U.S. Cl.

CPC ..... *D06F 58/04* (2013.01); *A62C 3/00* (2013.01); *A62C 3/16* (2013.01); *A62C 35/10* (2013.01); *D06F 58/28* (2013.01); *D06F 2058/2829* (2013.01); *D06F 2058/2858* (2013.01); *F26B 25/009* (2013.01)

(58) Field of Classification Search

CPC .. D06F 58/28; D06F 58/04; D06F 2058/2829; D06F 2058/2858; A62C 3/00; A62C 3/16; A62C 3/006; A62C 35/10; A62C 35/02; F26B 25/009; F26B 25/00

USPC .... 34/544, 524, 543, 109, 108, 599; 169/54, 169/56, 57; 68/209

See application file for complete search history.

(56) References Cited

U.S. PATENT DOCUMENTS

| | | | | |
|---|---|---|---|---|
| 1,378,964 A * | 5/1921 | Lang | 68/209 | |
| 2,470,043 A * | 5/1949 | Monsarrat | 34/534 | |
| 2,673,727 A * | 3/1954 | Smith | D06F 58/02 34/595 | |

(Continued)

FOREIGN PATENT DOCUMENTS

| | | |
|---|---|---|
| EP | 2360310 A1 | 8/2011 |
| GB | 2205037 A | 11/1988 |

(Continued)

OTHER PUBLICATIONS

English Machine Translation: EP 2360310.*

(Continued)

*Primary Examiner* — Jianying Atkisson
*Assistant Examiner* — Tavia Sullens
(74) *Attorney, Agent, or Firm* — Nixon & Vanderhye P.C.

(57) ABSTRACT

A tumble dryer, in particular a household tumble dryer, includes a housing, a drum intended for laundry to be dried, which is supported rotatably in the housing, and a container positioned on an outer face of the lateral surface of the drum and holding an extinguishing agent. The container has a first temperature-activated release facility which automatically releases the extinguishing agent into a space outside the drum, in the presence of a temperature produced by a fire.

20 Claims, 2 Drawing Sheets

(56) References Cited

U.S. PATENT DOCUMENTS

| | | | | |
|---|---|---|---|---|
| 6,715,216 | B1 * | 4/2004 | Salameh | D06F 58/28 34/595 |
| 6,948,567 | B1 * | 9/2005 | Cyphers et al. | 169/54 |
| 7,182,143 | B2 * | 2/2007 | Hall et al. | 169/57 |
| 7,921,578 | B2 * | 4/2011 | McAllister | D06F 58/203 134/10 |
| 2009/0159301 | A1 | 6/2009 | Chatot et al. | |
| 2009/0276966 | A1 * | 11/2009 | Mette | D06F 37/065 8/158 |
| 2011/0005781 | A1 * | 1/2011 | Yasui et al. | 169/54 |
| 2013/0056231 | A1 * | 3/2013 | Chatot et al. | 169/70 |

FOREIGN PATENT DOCUMENTS

| | | | | |
|---|---|---|---|---|
| JP | 60066800 | A * | 4/1985 | D06F 58/04 |
| JP | 9056996 | A | 3/1997 | |
| WO | WO 2011138383 | A1 * | 11/2011 | |

OTHER PUBLICATIONS

JP 60-066800: English Translation. Translated by FLS, Inc. for United States Patent and Trademark Office, Jan. 2014.*

"Lateral." In The American Heritage (r) Dictionary of the English Language. Boston: Houghton Mifflin, 2011. http://search.credoreference.com/content/entry/hmdictenglang/lateral/0 (accessed Jun. 14, 2014.).*

Report of Examination DE 10 2012 200 075.5 dated Jun. 14, 2012.

* cited by examiner

TUMBLE DRYER WITH AUTOMATIC FIRE EXTINGUISHING SYSTEM

BACKGROUND OF THE INVENTION

The present invention relates to a tumble dryer and in this instance in particular a household tumble dryer according to the preamble of the independent claim.

A tumble dryer of this type is known from each of the previously published documents JP 09 056 996 A, EP 2 360 310 A1 and DE 38 09 754 A1. According to each of these documents a temperature-activated release facility for releasing extinguishing agent in the event of a fire is provided in each instance.

It can always happen with tumble dryers that certain small elements, for example lint or other impurities, for example dust from abraded drive belts, collects and is deposited in the interior of the tumble dryer, for example in the base region of the housing. When a certain temperature is reached, these elements could catch fire. This has to be prevented. In some regions corresponding test methods are already in force or will soon be in force to demonstrate that fire cannot exit from the tumble dryer. To this end, it will be verified for example in the US from 2013 that a cloth placed over the tumble dryer cannot ignite during the test.

Tumble dryer manufacturers are therefore keen to be able to offer tumble dryers in which fire can be actively extinguished in the interior of the tumble dryer or in which the fire can at least be prevented from exiting to the outside. To this end it is known for example from DE 10 2007 061 521 A1 that the fire can be actively controlled by extinguishing using water or other chemicals from a container disposed above the drum, once the extinguishing operation has been triggered by a temperature sensor. However such a solution generally requires a functioning power supply to operate the temperature sensor, the associated control technology and evaluation circuits and optionally also further facilities.

Alternatively it is also possible to control the fire passively by no longer using any readily combustible plastic parts, just fire-resistant plastics, metals or other materials. However this is only possible if higher production costs are accepted.

A fire extinguishing apparatus for tumble dryers according to the preamble of claim 1 is known from DE 38 09 754 A1. Disposed below the worktop is a container having a number of cells, in which an extinguishing agent is stored. Holes are provided on the lower faces of the cells, being closed off with the aid of a protective cover or destructible membrane and being destroyed in the presence of flames or at a temperature above a predefined limit temperature. When the limit temperature is reached, the extinguishing agent is therefore released and drops down to extinguish the occurring fire. According to one alternative embodiment a pressurized container of extinguishing agent is provided, from which lines lead to points considered to be at risk of fire. In the event of a fire or high temperature the lines can melt, thereby breaking or opening. This releases the extinguishing agent.

The tumble dryers known from the publications cited above however have the disadvantage that the extinguishing agent is only released at previously determined points and therefore a fire occurring at any random point may not be reliably extinguished.

BRIEF SUMMARY OF THE INVENTION

It is an object of the present invention to propose a tumble dryer, in particular a household tumble dryer, in which a fire occurring in the interior of the tumble dryer cannot in any way exit from the tumble dryer and is extinguished automatically where possible, without requiring a connection to a power supply. This is to be achieved also by distributing the extinguishing agent as regularly as possible in the tumble dryer.

This object is achieved with a tumble dryer as claimed in the independent claim. Advantageous and preferred developments of the invention are the subject matter of the dependent claims, the description which follows and the accompanying drawing.

An inventive tumble dryer comprises a housing, a drum intended to hold laundry to be dried, which is supported in the housing in such a manner that it can rotate about a horizontal axis, and at least one container, which can hold or already contains—generally fluid—extinguishing agent. The at least one container has a temperature-activated first release facility, which is embodied so that it releases the extinguishing agent automatically at a temperature as produced by an existing or incipient fire. The first release facility here is embodied so that it dispenses the extinguishing agent into the housing—outside the drum.

According to the invention the container is positioned on the outer face of the drum, not on the two end faces but on the lateral surface. Therefore when the release facility allows the extinguishing agent to be dispensed from the container into the space outside the drum, the extinguishing agent is distributed in a relatively regular manner over said space and not just dispensed at one point, as it can be assumed that the drum is (still) in motion when a fire starts. The rotating drum therefore ensures relatively regular distribution of the extinguishing agent in the housing and therefore very reliable fire control. Even if no drum motion is registered when the extinguishing agent is released, the extinguishing agent is released relatively centrally within the housing and can therefore be distributed effectively over the region below the container if the release facility is embodied correspondingly.

The inventive tumble dryer with the described fire extinguishing system operates passively, i.e. there is no electrical system, electronic system or control technology present, which would require connection to a power supply. The inventive embodiment of the tumble dryer with the fire extinguishing system also ensures that fire can never exit from the tumble dryer.

One further advantage of the invention is that the tumble dryer is very reliably protected from a fire, as when there is a fire in the housing, additional extinguishing agent does not have to be conveyed or pumped into it, it is simply necessary to activate the release facility as part of the fire extinguishing system, to release the extinguishing agent in situ.

According to one advantageous development of the invention at least two containers are positioned on the outer face of the drum casing, the containers being at the same angular distance from one another. Thus for example two containers are distributed at an angular distance of 180° or three containers at an angular distance of 120° over the circumference of the drum casing, thereby ensuring even more regular distribution of the extinguishing agent on activation of the release facility, even if the drum is only rotating slowly or not at all. The arrangement of the containers at the same angular distance from one another also has the advantage that no imbalance results at the drum due to the containers.

It is preferable for at least one of the containers to project into the interior of the drum within the drum casing. If the overall volume of said container, of which part projects into the interior of the drum, is no different from that of a container that is totally outside the drum, the space requirement for the container outside the drum is smaller. If all the containers present are embodied thus, it is therefore possible to reduce the outer circumference of the drum with the containers.

A particularly advantageous embodiment of the inventive tumble dryer results, if the at least one container has a further, second temperature-activated release facility, which releases the extinguishing agent automatically into the interior of the drum at a temperature produced by a fire. In other words extinguishing agent can be released from a single container both into the interior of the drum and into the outer space of the drum (within the housing naturally). As it can be assumed that the temperature in the part of the tumble dryer where a fire is starting will rise significantly—the space outside the drum being used here by way of example—while in the other regions—in this example the interior of the drum—the temperature will not rise so significantly, the release facility in the relevant, hotter region is activated. In this example therefore extinguishing agent is released into the space outside the drum by means of the first release facility. As the second release facility is not activated at the same time, all the extinguishing agent is conveyed in the direction of the seat of the fire and not "wasted" in regions where no fire has started. This is also true of course conversely, when a fire occurs within the drum, with the second release facility then being activated and causing the extinguishing agent to be introduced into the drum. This allows the total quantity of extinguishing agent that has to be kept in reserve to extinguish a fire reliably to be minimized.

A particularly compact variant of the inventive tumble dryer involves embodying at least one of the containers so that it has an inner part projecting into the interior of the drum, which is configured at the same time as a laundry agitator. This allows the space requirement for facilities within the drum, which are not used to hold the laundry, to be minimized. Thus only very little space for holding laundry is lost.

It is preferable to configure at least one of the release facilities, even more preferable to configure all the release facilities, from a plastic, which melts when a fire starts or has already started in the tumble dryer, thereby releasing the extinguishing agent in the relevant container. It is advantageous here if the plastic has correspondingly thin walls, so that it responds as sensitively as possible to a rising temperature and melts. The plastic is preferably polypropylene, it also being possible to use other plastics with an appropriate melting temperature and melting rate. The containers for holding the extinguishing agent can be made of metal or even from the same plastic. In the latter instance it should of course be ensured that the release facilities are embodied in such a manner, generally with thin walls, that they melt before the containers in order to ensure controlled release of the extinguishing agent. Each release apparatus here is preferably incorporated in the container in the manner of a window and serves as a "rupture point" in the wall of the container. Since fires within the housing, as caused for example by cotton lint, wool lint or small plastic elements, can easily reach temperatures of 500° C. to 800° C. and higher, it is sufficient for the release facility to be activated, e.g. to melt, at a temperature below the abovementioned temperature range, which can be the case for example around 350° C. to 450° C. Such a release apparatus is therefore a purely "mechanical" apparatus and thus does not require a connection to a power supply.

It is advantageous if at least one of the release facilities extends over the entire axial length of the drum (or at least a substantial part thereof) and is embodied so that, when activated, it forms a number of openings which are distributed over the entire axial length or at least a large part thereof. The released extinguishing agent is then distributed over the entire axial length of the drum and therefore the corresponding extension of the housing and thus always reaches the occurring fire. If the formed openings are embodied correspondingly, it is also possible for the released extinguishing agent to be sprayed or atomized, which in particular is further assisted by rotation of the drum with the containers and release facilities fastened thereto. The resulting finely distributed mist of extinguishing agent is particularly suitable for controlling a fire.

It can be advantageous if the container has a closable filler opening for the extinguishing agent. A user can then check regularly that the container is completely full of extinguishing agent. This configuration also allows an inventive tumble dryer to be transported to the site of use without extinguishing agent and the container then to be filled with extinguishing agent in situ. The option of being able to fill the container by means of the filler opening has the further advantage that the container can be refilled, when the described extinguishing system has been active, without the entire container with associated lines and valves, etc. also having to be replaced. This is particularly advantageous, if the damage caused by the fire is so limited that it is worthwhile to reuse the tumble dryer after deploying the extinguishing system and replacing or repairing the damaged parts.

It is one advantage of the present invention that the container has to have a volume of maximum around three to four liters, as from experience this quantity is sufficient to extinguish any fire that occurs completely.

According to one advantageous embodiment of the inventive tumble dryer the container is already filled by the manufacturer with water plus an extinguishing additive to enhance the extinguishing effect. This prevents an inventive tumble dryer inadvertently being operated before the extinguishing agent has been introduced, without this having to be detected for example by means of electronic monitoring sensors.

BRIEF DESCRIPTION OF THE DRAWINGS

Further advantages, features and particularities of the invention will emerge from the description which follows of advantageous embodiments with reference to the figures in the accompanying drawing, in which.

DETAILED DESCRIPTION OF EXEMPLARY EMBODIMENTS OF THE PRESENT INVENTION

Figure 1:
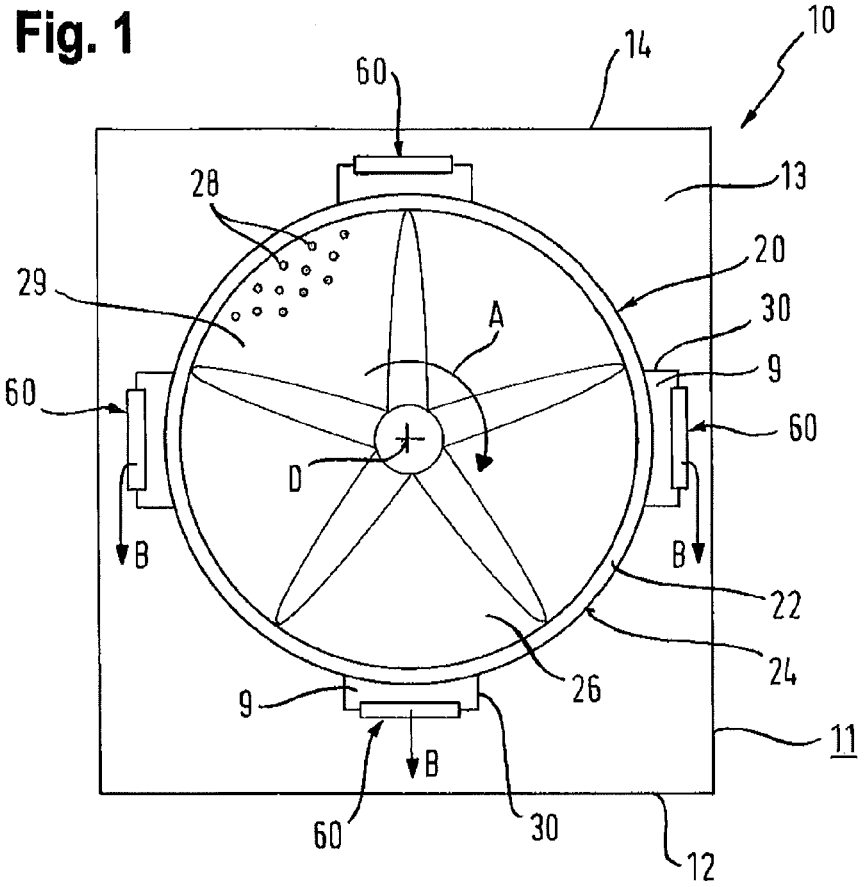
FIG. 1 shows a schematic diagram of a cross section through a first embodiment of a tumble dryer perpendicular to the rotation axis of the drum.

FIG. 1 shows a schematic diagram of a first embodiment of the tumble dryer 10. Present in a housing 11, which is delimited at the bottom by a base plate 12 and at the top by a worktop 14, is a drum 20, into which the laundry to be dried is introduced. The tumble dryer 10 and the drum 20 present therein are shown in a rear view, in which the rear wall 29 of the drum 20 can be seen, having a large number of small openings 28 for the passage of air. The drum 20 can be rotated about a rotation axis D running perpendicular to the plane of the drawing according to FIG. 1, as shown by an arrow A.

Positioned on the outer face 24 of the drum casing 22 in this embodiment at an angular distance of 90° are four containers 30 containing an extinguishing agent 9. Each container 30 has a temperature-activated release facility 60, which is embodied so that after being activated at a certain temperature, as produced in a fire, it releases the extinguishing agent 9 automatically into a space 13 within the housing 11 and outside the drum 20.

Figure 2:
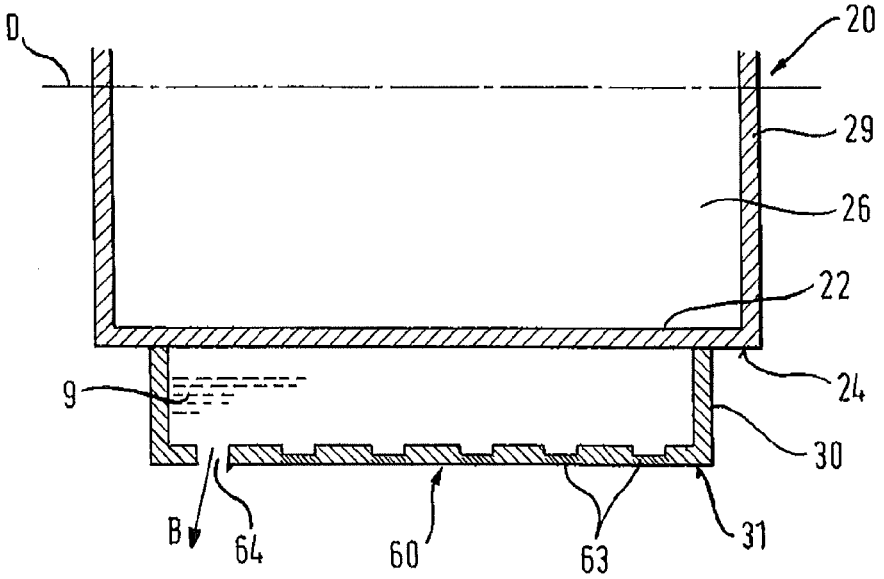
FIG. 2 shows a schematic diagram of a cross section through the drum of the tumble dryer from FIG. 1 parallel to the rotation axis of the drum, said drum being provided with a container.

Details of the first release facility 60 are shown in FIG. 2, which shows an enlarged diagram of a drum 20 with a container 30 positioned thereon. As described above, each container 30 is fastened to or positioned on the outer face 24 of the drum casing 22. Provided on the face 31 of the container 30 facing away from the drum 20 is the first release facility 60, which is configured as a plurality of thin-walled plastic regions 63, which are incorporated in the manner of windows in the face 31 of the container 30 facing away. The plastic regions 63 are preferably formed from polypropylene. The material of the plastic regions 63 and their thickness are selected so that they melt at a certain temperature of for example above 150° C., preferably around 200° C. to 450° C. Such temperatures are reached easily when a fire starts in the tumble dryer 10, as this can result in temperatures of 500° C. to 800° C. As soon as the plastic regions 63 or at least some of them have melted, a number of openings 64 are formed by the melting process, through which the extinguishing agent 9 can flow out, as shown by the arrow B.

As soon as a fire starts in the tumble dryer 10 therefore, the extinguishing agent 9 is released automatically by the first release facility 60 into the space 13 within the housing 11 of the tumble dryer 20 outside the drum 20. As a power supply is not required to activate the temperature-activated release facility 60, with said process simply being brought about by the plastic regions 63 melting due to the temperatures reached to form the openings 64, this fire extinguishing system operates in a very reliable manner without maintenance.

The containers 30 can be formed from metal but can also be made of plastic, which should then have a greater wall thickness and/or a higher melting temperature.

As shown in FIG. 2, the plastic regions 63 of the release facility 60 are distributed over almost the entire axial length of the drum 20. This has the advantage that the extinguishing agent 9 can be distributed in a very regular manner into the interior 13 of the housing 11 of the tumble dryer 10, in particular if the drum 20 is still rotating. If a very large number of roughly point-like small openings 64 are formed when the release facility 60 is activated, the extinguishing agent can be released in the manner of a spray and thus atomized, thereby enhancing fire control efficiency further.

Figure 3:
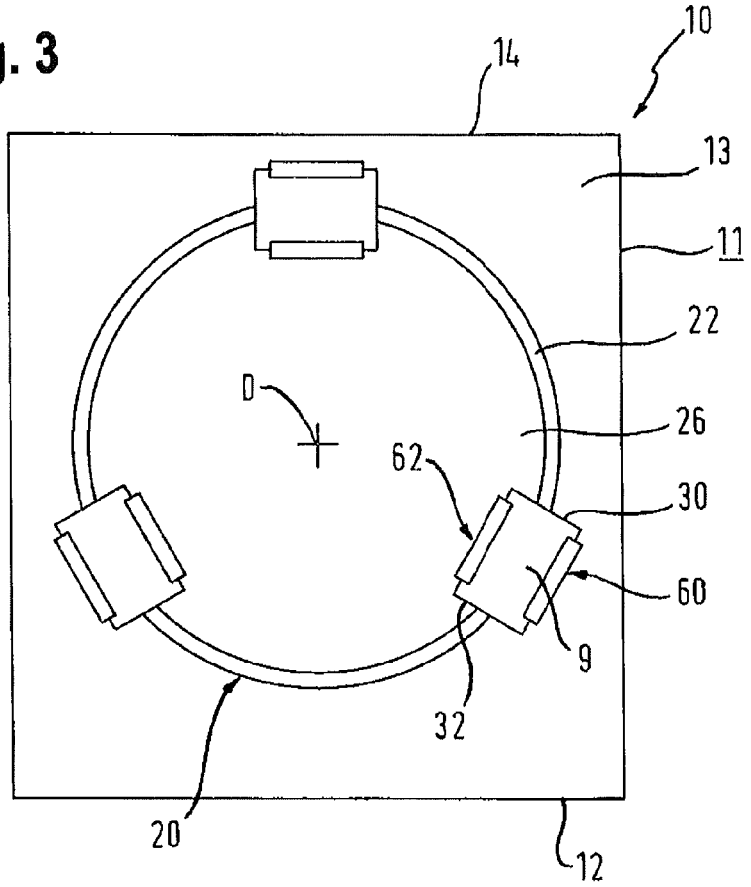
FIG. 3 shows a schematic diagram of a cross section through a second embodiment of a tumble dryer perpendicular to the rotation axis of the drum.
Figure 4:
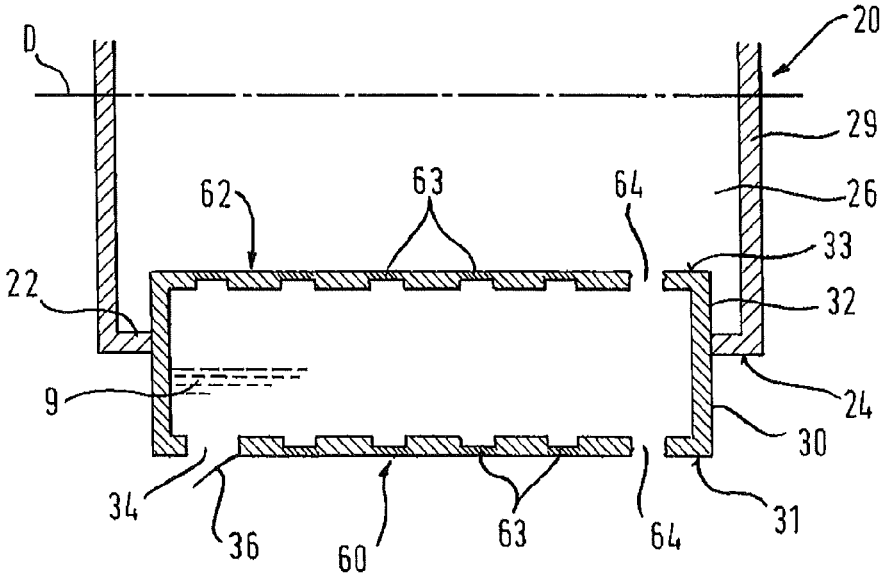
FIG. 4 shows a schematic diagram of a cross section through the drum of the tumble dryer from FIG. 3 parallel to the rotation axis of the drum, said drum being provided with a container.

FIGS. 3 and 4 show a second advantageous embodiment of the tumble dryer 10. The features explained in relation to FIGS. 1 and 2 also apply to the other embodiments, without this being repeated in detail. Therefore only the additional particularities of the further embodiments are described below in order to avoid unnecessary repetition.

While four containers 30 are provided in the first embodiment, only three containers 30 are provided in the second embodiment, being positioned so that they are distributed at an angle of 120° over the circumference of the drum 20 on the outer face 24 of the drum casing 22. Each of the containers 30 has an inner part 32, which projects into the interior 26 of the drum 20. This inner part 32 can be embodied here as a cuboidal container, which therefore has a right-angled cross section, but the inner part 32 can also have other cross sections, for example triangular or rounded cross sections. As with the first embodiment the container 30 has a release facility 60 on its face 31 facing away from the drum 20. The inner part 32 also has a further, second release facility 62 on its inner face 33 facing the rotation axis D of the drum 20. The second release facility 62 is preferably embodied in a similar or identical manner to the first release facility 60 but it opens into the interior 26 of the drum 20.

A major advantage of this embodiment is that the combination of the two release facilities 60 and 62 allows very "targeted" release of the extinguishing agent 9. Depending on whether a fire starts within or outside the drum 20, the temperature rises significantly either in the drum 20 or in the space 13 within the housing 11, while the temperature in the respectively other space rises but much less significantly. As a result therefore the release facility 60, 62, which "senses" a higher temperature, is always activated, as it is closer to the fire than the respectively other release facility. All the available extinguishing agent is therefore deployed precisely where it is required and no extinguishing agent is released at points where no fire has started. This enhances the efficiency of the fire extinguishing system, as generally only quite a small quantity of extinguishing agent has to be held in reserve, usually between three and four liters.

It may be advantageous, if the inner part 32 of the container 30 projecting into the interior 26 of the drum 20 is also embodied at the same time as a laundry agitator, so that said element has a double function and therefore takes up as little space as possible.

As shown in FIG. 4, the container 30 has a filler opening 34, which can be closed off by means of a cover 36. With this arrangement a user can check at any time whether there is sufficient extinguishing agent 9 in the containers 30 and top up the extinguishing agent 9 as required.

With the abovementioned embodiments the release facilities 60, 62 are only shown on the face of the container 30 facing away from the drum 20 or facing the rotation axis D. It is of course also possible to provide release facilities instead of or in addition to these on the respective end faces or narrow faces.

It is therefore possible without a connection to an electrical power supply for the release facility, in a technically simple, economical and reliable manner, to release the extinguishing agent automatically, thereby ensuring the extinguishing process for the occurring fire, when a limit value of ambient temperature is reached or exceeded.

The invention described above is of course not restricted to the two embodiments described in detail. The different variants of the fire extinguishing system can be used both in condensation dryers and in exhaust air dryers and in each instance ensure that any fire that occurs is extinguished reliably and automatically without requiring any external influence. As it is not necessary to have a connection to the power network or to provide a battery to operate or prepare the fire extinguishing system for operation, the reliability of the fire extinguishing system is also very high.

It should also be noted that features of the invention described with reference to individual embodiments, for example the configuration and arrangement of the container or the number of containers and of the release facilities, can also be present individually or cumulatively in other embodiments, unless otherwise stated or impossible for technical reasons.

The invention claimed is:

1. A tumble dryer, comprising a housing;

a drum intended for laundry to be dried, said drum being supported rotatably in the housing and having a drum casing, and at least one container positioned on a lateral outer face of the drum casing and holding an extinguishing agent, said at least one container having a temperature-activated first release facility which automatically releases the extinguishing agent into a space outside the drum in the presence of a temperature produced by a fire.

2. The tumble dryer of claim 1, constructed in the form of a household tumble dryer.

3. The tumble dryer of claim 1, further comprising a further said container positioned on the outer face of the drum casing, said containers being arranged at an angular distance of 180° from one another.

4. The tumble dryer of claim 1, further comprising at least three of said container positioned on the outer face of the drum casing, said containers being arranged at a same angular distance from one another.

5. The tumble dryer of claim 1, wherein the first release facility is made of polypropylene.

6. The tumble dryer of claim 1, wherein the at least one container has a closable filler opening.

7. The tumble dryer of claim 1, wherein the at least one container has an overall volume of maximum around 3 to 4 liters.

8. The tumble dryer of claim 1, wherein the space is between the drum and the housing.

9. The tumble dryer of claim 1, wherein the at least one container projects into an interior of the drum.

10. The tumble dryer of claim 9, wherein the at least one container has an inner part that projects into the interior of the drum, said inner part being embodied as a laundry agitator.

11. The tumble dryer of claim 9, wherein the at least one container has a temperature activated second release facility, which releases the extinguishing agent automatically into the interior of the drum at a temperature produced by a fire.

12. The tumble dryer of claim 11, wherein at least one of the first and second release facilities is made of a plastic, which melts when a fire starts or has started in the tumble dryer.

13. The tumble dryer of claim 11, wherein, wherein at least one of the first and second release facilities is made of a thin-walled plastic, which melts when a fire starts or has started in the tumble dryer.

14. The tumble dryer of claim 11, wherein at least one of the first and second release facilities extends over substantially an entire axial length of the drum.

15. The tumble dryer of claim 14, wherein the at least one of the first and second release facilities is configured to form a plurality of openings that are distributed substantially over the entire axial length of the drum.

16. A tumble dryer, comprising a housing;

a drum configured to hold laundry to be dried, said drum being supported rotatably in the housing and having a drum casing, and at least one container positioned on the drum and containing an extinguishing agent, said at least one container having a temperature-activated first release facility which automatically releases the extinguishing agent into an interior of the drum in the presence of a temperature produced by a fire, wherein the at least one container has a temperature activated second release facility, which releases the extinguishing agent automatically into an area between the drum and the housing at a temperature produced by a fire.

17. The tumble dryer of claim 16, constructed in the form of a household tumble dryer.

18. The tumble dryer of claim 16, wherein said at least one container includes at least three containers positioned on the drum, said containers being arranged at a same angular distance from one another.

19. The tumble dryer of claim 16, wherein the at least one container projects into an interior of the drum.

20. The tumble dryer of claim 19, wherein the at least one container has an inner part that projects into the interior of the drum, said inner part being embodied as a laundry agitator.

* * * * *